US006894656B2

(12) United States Patent
Apostolos et al.

(10) Patent No.: US 6,894,656 B2
(45) Date of Patent: May 17, 2005

(54) SYMMETRIC, SHIELDED SLOW WAVE MEANDER LINE

(75) Inventors: John T. Apostolos, Merrimack, NH (US); Patrick McKivergan, Londonderry, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 70 days.

(21) Appl. No.: 10/378,336

(22) Filed: Mar. 3, 2003

(65) Prior Publication Data

US 2004/0174313 A1 Sep. 9, 2004

(51) Int. Cl.[7] ..... H01Q 11/14
(52) U.S. Cl. ..... 343/841; 343/744
(58) Field of Search ..... 343/744, 700 MS, 343/841

(56) References Cited

U.S. PATENT DOCUMENTS

| | | | | |
|---|---|---|---|---|
| 5,790,080 | A | 8/1998 | Apostolos | |
| 6,313,716 | B1 | 11/2001 | Apostolos | |
| 6,323,814 | B1 | 11/2001 | Apostolos | |
| 6,373,440 | B2 * | 4/2002 | Apostolos | 343/744 |
| 6,373,446 | B2 | 4/2002 | Apostolos | |
| 6,396,460 | B2 * | 5/2002 | Tseng et al. | 343/895 |
| 6,404,391 | B1 | 6/2002 | Apostolos | |
| 6,480,158 | B2 | 11/2002 | Apostolos | |
| 6,492,953 | B2 | 12/2002 | Apostolos | |

OTHER PUBLICATIONS

U.S. Appl. No. 60/435,099, filed Dec. 20, 2002, Apostolos.

* cited by examiner

*Primary Examiner*—James Vannucci
(74) *Attorney, Agent, or Firm*—Daniel J. Long; Robert K. Tendler

(57) ABSTRACT

A standard slow wave meander line having sections of alternating impedance relative to a conductor plate is provided with a top shield connected to the conductor plane for the purpose of lowering the resonant frequency of narrow band antennas and lowering the low frequency cutoff limit of wide band antennas due to a higher delay per unit length occasioned by the use of the top shield. The shielded meander line may be utilized as a coupling device to truncated antennas such as a whip antenna or grounded loop antenna for the purposes of loading the antenna so as to provide lower frequency performance. Since the propagation constant of the meander line structure depends upon the number of high impedance/low impedance transitions per unit length, the utilization of the top shield results in more phase shifts per unit length and thus more delay per unit length, with the symmetric double sided version having double the number of transitions per unit length. When configured to provide a miniature antenna, the utilization of the top shield both lowers the cutoff frequency and eliminates down firing typical of wireless phone antennas due to the ground plane effect. Moreover, the top shield provides a uniform low VSWR over wide bandwidths and by virtue of lowering the operating frequency solves a skip-induced blackout problem due to the lower frequencies that can now be used. Further, for frequency switched meander lines, voltage stress is reduced when using the top shield. Finally, reducing the volume requirement by over 30% permits mobile use where real estate is at a premium.

5 Claims, 6 Drawing Sheets

SYMMETRIC, SHIELDED SLOW WAVE MEANDER LINE

FIELD OF INVENTION

This invention relates to meander line structures and particularly to the utilization of a top shield.

BACKGROUND OF THE INVENTION

Slow wave meander line loaded antennas are known, with the meander line providing for a narrow band and a wide band response, depending on the application. One patent describing such a slow wave meander line structure is U.S. Pat. No. 6,313,716 assigned to the assignee hereof and incorporated herein by reference. In this meander line embodiment, the meander line includes an electrically conductive plate, and a plurality of transmission line sections supported with respect to the conductive plate. The plurality of sections includes a first section loaded relatively closer and parallel to the conductive plate to have a relatively lower characteristic impedance with the conductive plate, and a second section located parallel to and at a relatively greater distance from the conductive plate than the first section to have a relatively higher characteristic impedance with the conductive plate. A conductor is provided for interconnecting the first and second sections and maintaining an impedance mismatch therebetween.

These meander line structures can utilized either as antennas themselves or as coupling devices to antennas such as described in Provisional Patent No. 60/435,099 filed Dec. 20, 2002 by John T. Apostolos entitled VITL Based Universal Antenna Coupler. The largest problem with such meander line structures is their low frequency cutoff. While meander lines are used to provide a compact or miniaturized device no matter what the frequency band, for each band obtaining a lower frequency cutoff is important.

For instance, for low frequency communication in which a grounded loop antenna replaces the traditional whip antenna mounted to a vehicle, the ability to operate down to 4 MHz is vitally important. The low frequency requirement is to assure close-in sky wave communications by having the take-off angle as steep as possible. However, getting a miniaturized coupler to operate at 4 MHz is a problem. Either meander line couplers have to double their footprint over what is acceptable or the antenna has to be elongated and may extend up too far, meaning it can get caught on trees or overhanging vegetation, to say nothing of low lying power or telephone lines.

Moreover, meander line couplers can have various meander line sections switched in and out to change the frequency at which the meander line is tuned. Because the PIN diode or FET switches are placed between a high impedance section of the meander line and a low impedance section, the open switch differential voltage across the switch may be in excess of 10,000 volts. This causes substantial voltage stress that can cause the switches to fail, which in turn limits the transmit power allowed so as not to burn out the switches. While in a tactical situation one might want to switch from 100 watts to 300 watts, switch failure would prevent one from so doing.

Going from military to civilian use, for the cellular and PCS bands it is important to provide a miniature wide band antenna that can operate between 800 and 3,000 MHz. Unfortunately it is only with difficulty that one can get below 1500 MHz using standard meander line loaded antennas. In short, for standard meander line loaded antennas there is a severe low frequency threshold. This limits how low a cutoff frequency for the meander line can be. What is needed is a breakthrough in the low frequency cutoff of meander line loaded antennas for such applications.

A third application is for military communications in the 30–88 MHz band. What is required is a reduced footprint antenna that is small enough to be carried on a vehicle or aircraft and yet operate in the 30–88 MHz band. Standard meander line loaded antennas, while small, are nonetheless too large at 30 MHz. Again, what is needed is a breakthrough in the lowering of the low frequency cutoff for meander line structures in the 30–88 MHz range so that a suitably sized device will work.

Whether it be for 4 MHz communications, 30 MHz communications or 800+ MHz communications, there is a need for a compact device having a reduced the low frequency cutoff. Note that a standard meander line coupler at 4 MHz would have a footprint of 28"×50", too large to be placed on the top of a small vehicle. For the 30–88 MHz range a meander line loaded antenna would have to be as large as 16"×48"×48", too large for vehicle or aircraft use. In the cellular and PCS applications, meander line loaded antennas are only 0.3" high×1.2" wide×1.2" long. However, their low frequency cutoff is approximately 1500 MHz, too far above the cellular 800 MHz band.

What is therefore necessary is a new meander line configuration to dramatically lower the low frequency cutoff of such devices.

By way of further background, for military use, taking a tactical situation in which a soldier or vehicle needs to communicate with another soldier or vehicle at some distance away, typically communications is provided through the use of a ground wave and also from skip off the ionospheric layer. While a ground wave is usually viable up to about 30 miles from the transmission site, if the skip angle is shallow, there will be a significant blackout or dead zone along the ground, say from 30 miles to 100 miles, where there will be no communications possible. This is because the transmitted radiation skips over this ground segment before it is reflected down to the surface of the earth.

When depending on a sky wave or a skip for robust communications, the takeoff angle of the radiation is indeed important. It is noted that the higher the frequency the more shallow is the takeoff angle such that there is more of an extended dead zone which starts at the transmission site and extends to the point at which radiation reflected from the ionosphere strikes the surface of the earth. This means that there is a communications blackout zone, for instance, between 30 miles and 100 miles when a transmitter is operating in the 5 MHz frequency band. This is because of the somewhat shallow takeoff angle in which no radiation from the transmitter reaches a position on the surface of the earth beyond the point at which the ground wave dissipates. Thus in the above example, there would be no communication possible between 30 miles and 100 miles from the transmitter.

Where it possible to be able to lower the operating frequency of the transmitter to, for instance, 4 MHz, then the takeoff angle would be higher and radiation returned from the ionosphere would be closer to the transmitter, e.g. between 30–100 miles of the transmitter. What this means is that communications could established from the transmitter all the way up to the 30 mile limit of the ground wave transmission and then up to another 100 miles due to the sharper skip angle involved with operating at the lower frequency.

While it is certainly possible with a long whip antenna to be able to transmit at 4 MHz, it would be desirable to be able to use a short radiator and a meander line structure as a miniature coupler to permit operating at 4 MHz. Thus, rather than having to have a quarter wave antenna at 4 MHz, one needs to find how to construct a miniaturized coupler for a very short length whip or loop. One therefore needs to develop a meander line coupling device that without enlarging the device would lower the VSWR to less than 2:1 at the lower frequency. This would permit a continuum in the communications capabilities of the transmitter while at the same time using a smaller radiator and the same miniaturized meander line coupler.

For 30–88 MHz use, this is a frequency hopping communications band used extensively by the military. The antenna structures for this band are sizeable and there is a need to be able to reduce the size of the antenna structures so that they can be readily mounted to vehicles or aircraft. While meander line couplers and antennas have been proposed for such use, they cannot be made to operate close to 30 MHz, at least at sizes that are required. To make such an antenna operate at 30 MHz the size required is a volume 16" high×48" wide×48" long, or 36,864 cubic inches. This resulted in rejection of such antennas for tanks and some aircraft. If one could design a wideband antenna for this band at 10"×32"×32" or 10,240 cubic inches, then there is enough real estate on the vehicle due to a volume reduction of 3.7:1.

Another antenna related problem is one that is typical of cell phone antennas. First, one needs a compact wideband antenna that can cover the cellular band at 800 MHz, and the PCS bands at 1.7–1.9 GHz, as well as operating at the GPS frequency of 1.575 GHz. Getting a meander line loaded antenna to operate down to 800 MHz at the current size required is a challenge.

Moreover, there is another problem that needs to be resolved with wideband cellular antennas. Since most cell phone antennas are backed with a ground plane, usually the ground plane of the printed circuit board within the cell phone, there is a problem called "down firing", in which the major lobe of the antenna points into the ground. This limits the ability of the hand held device both in the receive and in the transmit mode because radiation transmitted from such a device is fired into the ground, whereas the receive characteristic is diminished in the horizontal direction. While meander line loaded antennas have been used in cell phones because of their small size and wide bandwidth operating in the 800 MHz, 1.7 GHz and 1.9 GHz bands, they nonetheless suffer from "down firing" at frequencies above 1.7 GHz. It would be convenient if some meander line structure could also eliminate the down firing problem.

SUMMARY OF THE INVENTION

In the subject invention, a standard slow wave meander line structure is provided with a top shield. This has a number of important effects. First, the resonant frequency of the device is significantly lowered, which means that its low frequency cutoff is likewise lowered. Secondly, the effective radiation pattern of a meander line loaded antenna has a major horizontal lobe unaffected by ground planes in a wireless device regardless of operating frequency, thus to eliminate down firing. Thirdly, if one wishes to have a frequency switched meander line structure, voltage stress on the switches can be reduced.

The subject invention is thus a modified a slow wave meander line structure that can be used as a coupling mechanism for 4 MHz transmissions without increasing its size, can be used as a wideband antenna for the 30–88 MHz applications, and can be used as a wideband cell phone antenna having a low cutoff frequency down to 800 MHz. The modified slow wave meander line structure also eliminates the ground plane "down firing" problem and eliminates switch stress in frequency switched meander lines.

To do this, a standard meander line structure having a conductor plate is provided with a top shield over the structure, with the shield being coupled to the conductor plate. The top shield lowers the operating frequency of a meander line by affecting the propagation constant of the meander line structure. The propagation constant relies on the number of high impedance/low impedance transitions per unit length. This characteristic is the result of the fact that each transition causes a fixed phase shift. The more phase shift per unit length, the more delay per unit length. When utilizing a top shield connected to the conductor plane, there are more phase shifts per unit length and therefore more delays per unit length. Put another way, with the same size meander line structure, its effective length is increased which lowers its operating frequency. The top shield thus provides a double-sided device that has double the number of transitions per unit length such that more delay is accrued.

What in essence is happening with the use of the top shield is that it turns what was a low impedance section between two high impedance sections into a high impedance section between two low impedance sections thus, when utilizing the top shield, the high impedance sections are now the vertical segments or sections of the meander line. The horizontal sections become the low impedance sections. If switches are put in these high impedance sections to switch the operating frequency of the meander line, then the switching stress is reduced. This means that the voltage differential across the switch is much decreased, it being from one low impedance section to another low impedance section. Thus, with the top shield an added advantage is that higher power communications can be achieved without switch burn out.

In order to provide such a dramatic break through it has been found that providing a grounded shield over this standard meander line structure significantly reduces the low frequency cutoff of the device without altering its size. The shield does so by changing the high/low impedance sections to one where the high impedance section is between two low impedance sections. Also, any switching is now done between two low impedance sections which drastically reduces voltage stress.

In one embodiment, the unshielded meander line when used as a coupler has a resonant frequency of 5.2 MHz, while the shielded meander has a resonant frequency of 4.05 MHz.

In summary, a standard slow wave meander line having sections of alternating impedance relative to a conductor plate is provided with a top shield connected to the conductor plane for the purpose of lowering the resonant frequency of narrow band antennas and lowering the low frequency cutoff limit of wide band antennas. This is due to a higher delay per unit length occasioned by the use of the top shield.

The shielded meander line may be utilized as a coupling device to truncated antennas such as a whip antenna or grounded loop antenna for the purposes of loading the antenna so as to provide lower frequency performance. Since the propagation constant of the meander line structure depends upon the number of high impedance/low impedance transitions per unit length, the utilization of the top shield results in more phase shifts per unit length and thus more delay per unit length, with the symmetric double sided version having double the number of transitions per unit length. When configured to provide a miniature antenna for use in wireless handsets, the utilization of the top shield both lowers the cutoff frequency and eliminates down firing typical of wireless phone antennas due to the ground plane effect. Moreover, the top shield provides a uniform low VSWR over wide bandwidths and by virtue of lowering the operating frequency solves a skip-induced blackout problem due to the lower frequencies that can now be used. Further, for frequency switched meander lines, voltage stress is reduced by using the top shield. Finally, reducing the volume requirement by over 30% permits mobile use where real estate is at a premium.

BRIEF DESCRIPTION OF THE DRAWINGS

These and other features of the subject invention will be better understood in connection with the Detailed Description in conjunction with the Drawings, of which.

DETAILED DESCRIPTION

Figure 1:
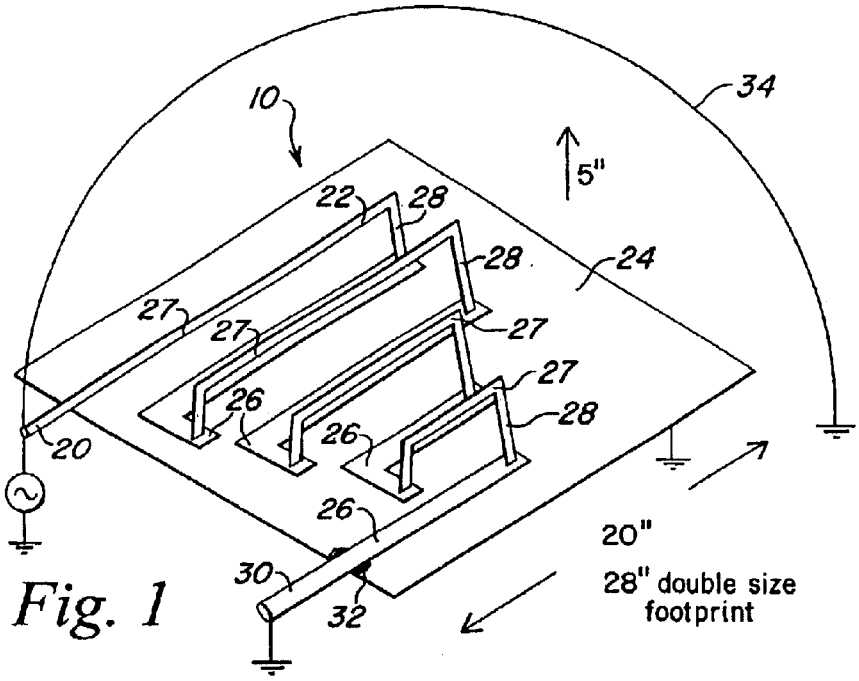
FIG. 1 is a diagrammatic illustration of the use of a standard meander line structure as a coupler to a grounded loop antenna.

Referring now to FIG. 1 and as described in U.S. Pat. No. 6,313,716, a slow wave meander line structure 10 is in the form of a folded transmission line 22 mounted on a plate 24. Plate 24 is a conductive plate, with transmission line 22 being optionally constructed from a folded microstrip line that includes alternating sections 26 and 27 which are mounted close to and separated from plate 24, respectively. This variation in height from plate 24 of alternating sections 26 and 27 gives these sections alternating impedance levels with respective to plate 24.

Sections 26, which are located close to plate 24 to form a lower characteristic impedance are electrically insulated from plate 24 by any suitable means such as an insulating material positioned therebetween. Sections 27 are located at pre-determined distance from plate 24, which predetermined distance determines the characteristic impedance of transmission line section 27 in conjunction with the other physical characteristics of the line as well as the frequency of the signal being transmitted over the line.

As illustrated, sections 26 and 27 are interconnected by sections 28 of the microstrip line which are mounted in an orthogonal direction with respective to plate 24. In this form the transmission line 22 may be considered as a single continuous folded microstrip line.

Note that one end of the meander line is illustrated by reference character 20, whereas the other end of the meander line is illustrated by reference character 30. Moreover, in one embodiment end 30 is electrically coupled to plate 24 as illustrated at 32.

In one embodiment, end 20 of the meander line may be connected to a grounded loop radiating element 34. This loop is grounded at one end, with the combination providing a narrow band antenna arrangement.

When operated at 4 MHz, the dimensions of such a unit is on the order of 50.4"×28"×10". For most mobile and aircraft applications, this footprint is double the desired size. As described above, what was needed was a breakthrough which would reduce the size of the footprint in half such that one embodiment with the subject top shield to be described, the footprint is now 36"×20"×5". The reduction in size over the standard meander line loaded antenna is a result of the top shield over such a structure.

Figure 2A:
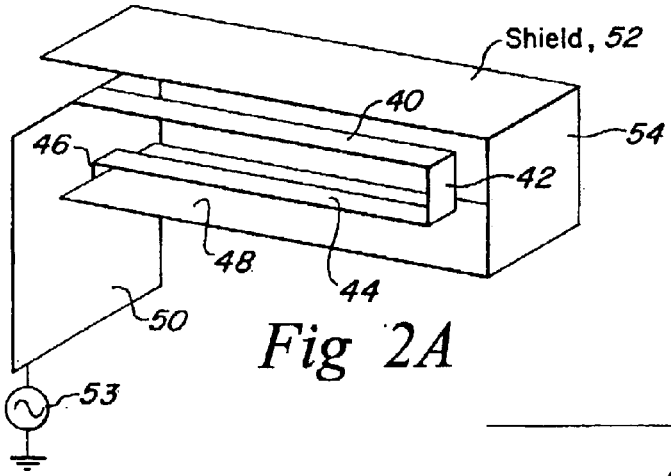
FIG. 2A is an isometric and schematic illustration of a shielded meander line structure illustrating the top shield.
Figure 2B:
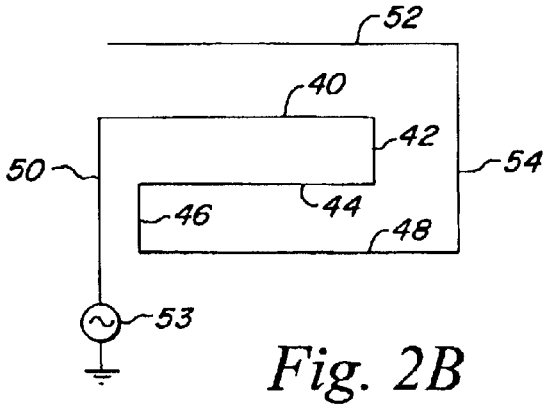
FIG. 2B is a schematic diagram of the meander line structure of FIG. 2A, showing the electrical connection of the top shield to the conductor plate of the meander line.

As will be seen in FIGS. 2A and 2B sections of alternating impedance relative to the conductor plate are provided with a top shield that lowers the operating frequency of the associated meander line. It does so by affecting the propagation constant of the meander line structure. The propagation constant relies on the number of high impedance/low impedance transitions per unit length. This characteristic is a result of the fact that each transition causes a fixed phase shift. The more phase shifts per unit length, the more delays per unit length. When utilizing the subject top shield connected to the conductor plate, there are more phase shifts per unit length and therefore more delays per unit length. This double-sided structure, thus, has double the number of transitions per unit length such that more delay is accrued.

As will be seen in FIGS. 3 and 4, when utilizing the top shield the high impedance sections are now the vertical segments of the meander lines. The horizontal sections therefore constitute the low impedance sections. The net result is that for the same footprint for the standard meander line structure, its effective length is doubled meaning that it can resonate at a lower cutoff frequency.

Referring now to FIG. 2A, in one embodiment such a meander line structure includes a top section 40 connected via a vertical section 42, in turn connected to a lower section 44 which is in turn connected via a conductive strip 46 to a bottom conductive plate 48. The meander line is fed via an upstanding plate 50 connected to a signal source 51 such that the signal is applied between ground and plate 50 to section 40 of the meander line. A top shield 52 is connected by an upstanding segment 54 to horizontal conductive plate 48, the effects of which will be described hereinafter.

Schematically and referring to FIG. 2B, top section 40 is connected by section 42 to lower section 44, which is in turn connected via conductive strip 46 to conductive plate 48 as illustrated. Plate 48 is connected via upstanding conductor 54 to shield 52 as illustrated, with the feed for the meander line structure being via upstanding plate 50 fed by signal source 51.

Figure 3A:
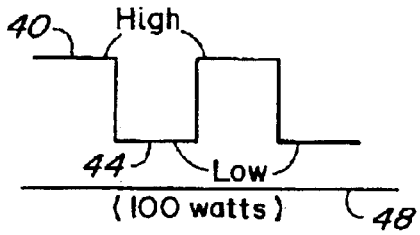
FIG. 3A is a waveform diagram illustrating the high and low impedance portions of a meander line structure.

Referring now to FIG. 3A, the diagram shows the relative impedances for the upper and lower sections of the meander line relative to conductor plate 48. Here it will be seen that the horizontally running upper section 40 is at a high impedance, whereas the lower section 44 is at a lower impedance. For extended meander line structures there is an alternation of high impedance and low impedance sections, with the number of sections being determined by the particular application.

Figure 3B:
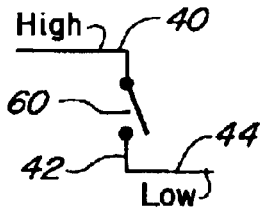
FIG. 3B is a schematic diagram of the interposition of a switch in the vertical transition between the high and low impedance sections of the meander line of FIG. 1 to be able to switch the operating frequency of the meander line, illustrating the high voltage stress on the switch due to the high to low impedance transition.

Referring to FIG. 3B, it can be seen that if the frequency of a meander line structure is to be changed, various sections may be switched into and out of the meander line. Here a switch 60 is interposed in the upstanding portion 42 which connects upper section 40 with lower section 44.

What will be seen is that the switch connects a high impedance section to a low impedance section. When the switch is open, there is significant voltage stress on the switch that may be from between 5,000 and 10,000 volts.

Here, if one wished to transmit 100 watts of power, then such a switching system could possibly be designed to tolerate the voltage stress. However, if one wanted then to increase the power of the transmitter from 100 watts to 300 watts, this could conceivably exceed the allowable voltage stress on the switch.

Figure 4A:
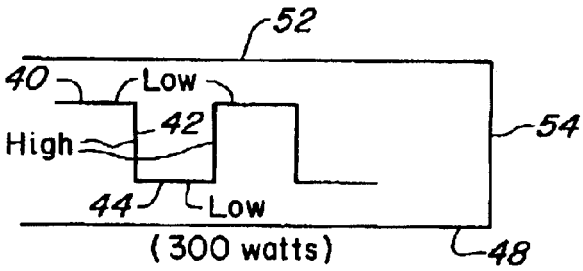
FIG. 4A is a waveform diagram of the result of providing a top shield on the impedance of the meander line segments illustrating a low impedance sector couple to another low impedance section through a vertical high impedance section, thus to double the number of impedance transitions for a given length meander line.

Referring to FIG. 4A, if the structure of FIG. 3A were provided with top shield 52, then the result would be as follows:

Top section 40 would become a low impedance section, whereas upstanding section 42 would become the high impedance section. This high impedance section would then be connected to low impedance section 44 and so on.

What will be seen is that the relative impedances of the various sections of the meander line are altered with the use of a top shield. In a given length transmission line there would be double the number of high impedance/low impedance transitions when using the top shield.

Figure 4B:
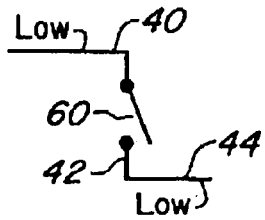
FIG. 4B is a schematic diagram of the interposition of a switch in the vertical high impedance transition between the low impedance sections of the meander line of FIG. 1 to be able to switch the operating frequency of the meander line, illustrating the a significant reduction in the voltage stress on the switch due to the low to low impedance transition.

Moreover, as illustrated in FIG. 4B switch 60 now connects a low impedance section 40 to another low impedance section 44 such that the voltage stress across switch 60 is minimized.

What this means is that when using a top shield there is considerably less voltage stress on the switches. This in turns translates into being able to handle increased output power from a transmitter.

Figure 5:
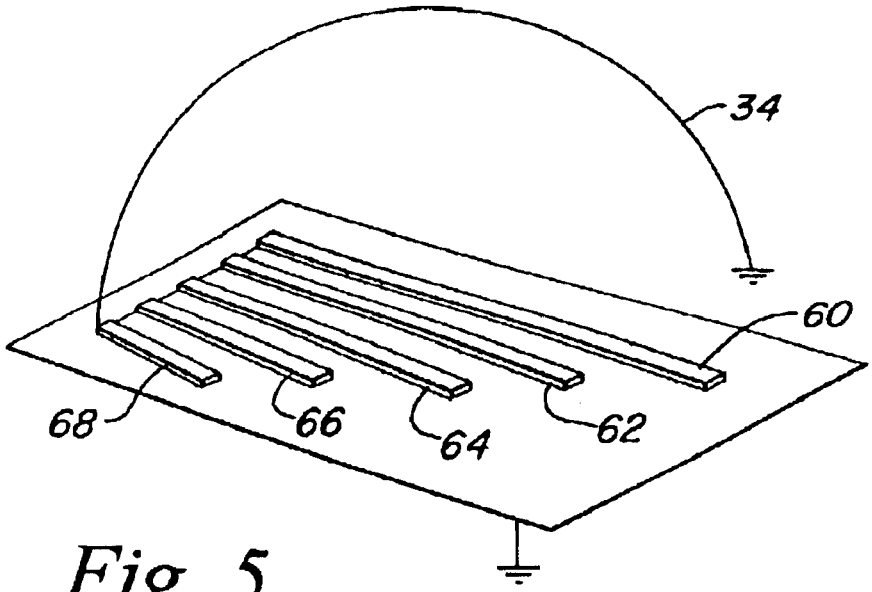
FIG. 5 is a diagrammatic illustration of a multiple section meander line used as a coupler to a grounded loop antenna.

Referring to FIG. 5, a slow wave meander line structure may include a number of sections 60, 62, 64, 66 and 68 which sections are connected together in general in the same manner as illustrated in connection with FIG. 1. When this device is utilized as an antenna coupler, grounded loop antenna 34 may be connected as illustrated.

Figure 6:
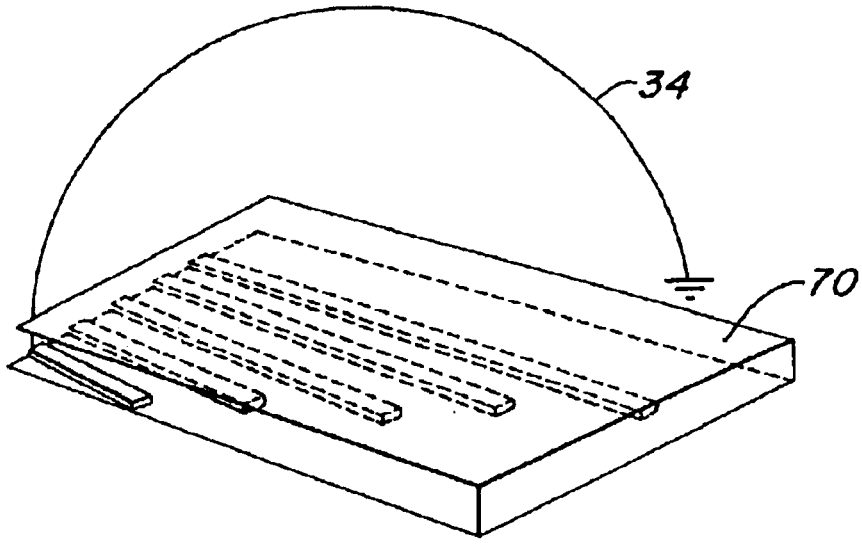
FIG. 6 is a diagrammatic illustration of the multiple section meander line coupler of FIG. 5, illustrating the use of a top shield to lower the low frequency cutoff of the meander line.

Referring to FIG. 6, when the structure of FIG. 5 is provided with a top shield 70, new characteristics make possible a lower cutoff frequency for the structure such that for a given size structure a lower cutoff frequency can mean the difference between communications and communications failure as will described in connection with FIG. 7.

Figure 7:
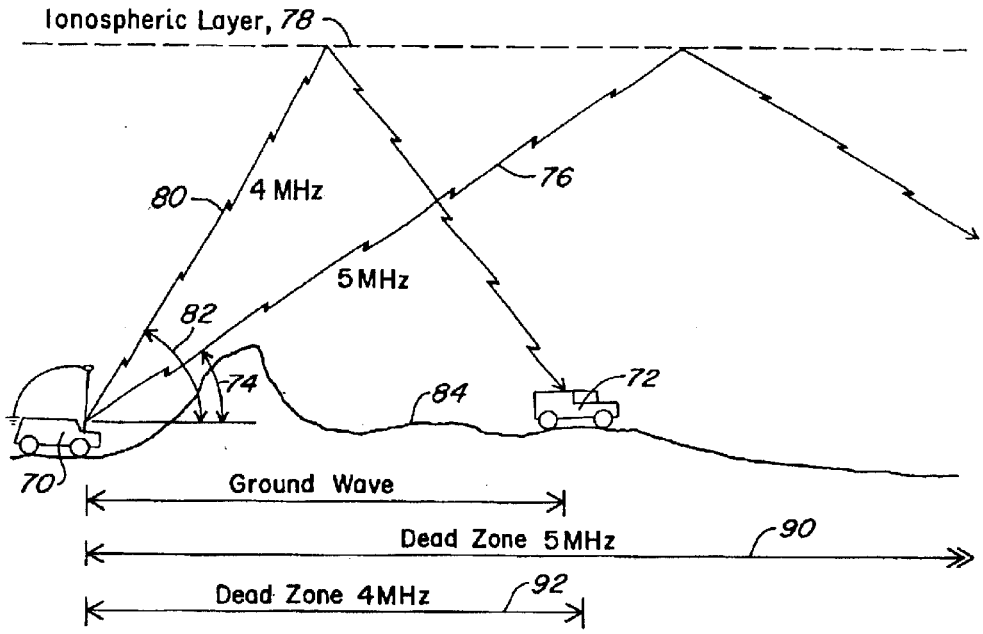
FIG. 7 is a diagrammatic illustration of a skip transmission scenario showing the effect of lowering the frequency of the transmission to eliminate a dead zone by increasing the take-off angle which decreases the skip distance.

As can be seen in FIG. 7, one operative embodiment of the subject invention involves a mounting of an antenna and coupler to a vehicle 70. Vehicle 70 carries a transmitter connected to the coupler. The purpose of utilizing the shielded embodiment of the coupler is such as to be able to establish communication between vehicle 70 and another vehicle 72 at some distance from vehicle 70.

Without the shield, a reasonably sized coupler and antenna can only be made to operate as low as 5 MHz. The result of the utilization of a 5 MHz carrier is that the takeoff angle 74 is shallow. This means that when radiation as illustrated at 76 is reflected by ionospheric layer 78, its point of impingement on the surface of the earth 79 is way beyond vehicle 72. In essence there is a skip-induced dead zone, the length of which is determined by the operating frequency of the transmitter.

If on the other hand utilizing the same sized coupler and antenna one could transmit at 4 MHz, then radiation as illustrated at 80 would be projected upwardly at a takeoff angle 82 which would result in communications with vehicle 72 at, for instance, a distance of 30+ miles. From a practical and tactical operational view point, communications between vehicle 70 and vehicle 72 can be achieved through the ground wave which dissipates at approximately 30 miles from the transmission source. The ground wave coverage is illustrated at 84. Skip or sky wave coverage then exists from 30 miles up to 100 miles.

What is accomplished by the utilization of a shielded meander line coupler is to provide a compact unit which can be vehicle-mounted and can establish communications from the transmit site by ground wave up to 30 miles and then by sky wave from 30 to 100 miles, thus eliminating the dead zone associated with operating at 5 MHz instead of 4 MHz. As can be seen, the dead zone at 5 MHz is illustrated by double ended arrow 90, whereas for 4 MHz the dead zone is illustrated by double ended arrow 92.

What can be seen is that by utilization of the shielded meander line structure, one can lower the low frequency cutoff of the coupler and antenna while at the same time providing for robust frequency shifting or switching at ever increasing transmit powers.

The subject shield meander line structure also has application in the 30 MHz–88 MHz range in which frequency hopping is utilized for covert operation.

Figure 8:
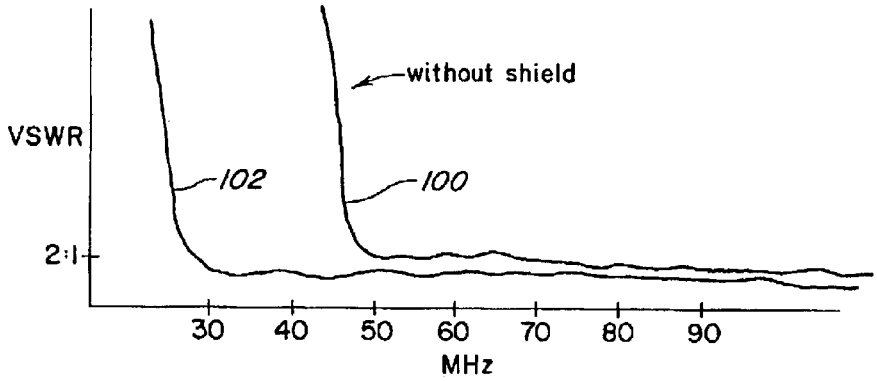
FIG. 8 is a waveform diagram of a compact meander line loaded antenna operating in the 30–88 MHz band illustrating the VSWR with and without the use of a top shield.

Referring to FIG. 8, what is shown is a VSWR graph versus frequency which indicates by line 100 that the cutoff frequency for a suitably sized meander line structure is on the order of 45 MHz. However, with the shielded meander line structure, as illustrated by line 102 the VSWR is at a very acceptable 2:1 at 30 MHz. In this embodiment the meander line structure is indeed a broadband device which operates critically down to the 30 MHz lower end of this particular band.

Figure 9:
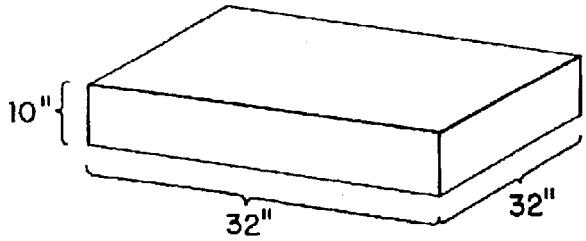
FIG. 9 is a diagrammatic illustration of the volume occupied by a meander line loaded antenna operating in the 30–88 MHz band illustrating the effect of using a top shield to reduce the volume to 10,000 square inches.

As illustrated in FIG. 9, a suitable meander line loaded antenna can be construed in a volume 32"×32"×10", whereas without the subject top shield, the meander line structure would have to be enlarged by double, unacceptable for mounting on aircraft or ground based vehicles.

The top shielded meander line structure is also of significant advantage when wide band antennas are to be utilized in wireless handsets.

Figure 10A:
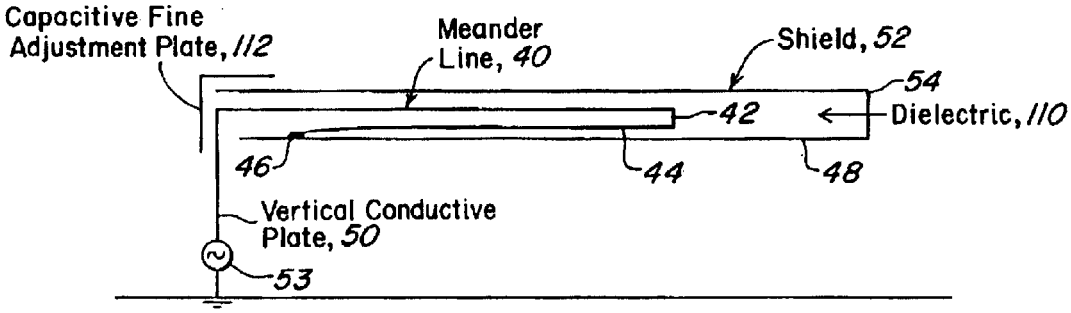
FIG. 10A is a schematic diagram of a meander line loaded antenna with a top shield for use as a wideband device for use in wireless handheld communications in which the top shield lowers the low frequency cutoff below the cellular band.

Referring now to FIG. 10A, a meander line loaded antenna is constructed from the aforementioned top section 40, upstanding section 42, lower section 44, conductor 46 and conductive plate 48, with top shield 52 being connected to plate 48 by upstanding member 54. The antenna is fed by a vertical conductive plate 50 as described above fed by signal source 51. The structure thus described is filled with dielectric material 110, with a capacitive fine adjustment plate 112 being positioned as illustrated.

The utilization of a wide band meander line loaded antenna for wireless hand held units achieves the benefit of compact size, in one embodiment 1.2"×1.2"×0.3", with a relatively low VSWR across not only the cellular band, and the PCS band as well as the GPS band, but also out to 6 GHz.

How this is accomplished is through the utilization of the meander line techniques described above in combination with the ability to lower the low frequency cutoff of the meander line loaded antenna. Were it not for the top shielding, the lowest frequency at which the antenna would radiate would be approximately 1750 MHz. This is clearly above the popular cellular band at 800 MHz.

Figure 10B:
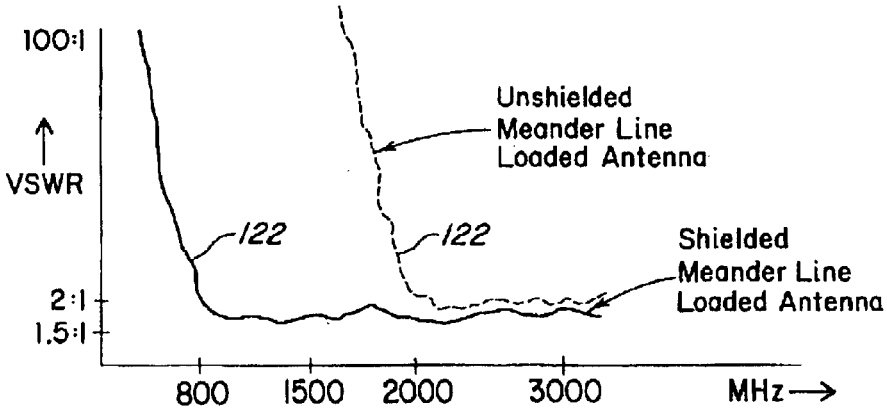
FIG. 10B is a waveform diagram illustrating the VSWR for the top shielded meander line loaded antenna of FIG. 10A, comparing it to the VSWR of an unshielded meander line loaded antenna of the same size.

By providing the top shield, the low cutoff frequency of the antenna is drastically reduced, which can be seen by the graph of FIG. 10B. Here, the VSWR is 2:1 at 780 MHz. As can be seen by line 120 the low frequency cutoff of such a wireless handset antenna in one instance is around 1750 MHz. However, by utilizing the shield, as illustrated by line 122, the VSWR can be maintained below 2:1 at 800 MHz.

Thus a compact wide bandwidth antenna is now available for handheld use in which the antenna may be embedded into the handheld unit.

Figure 11:
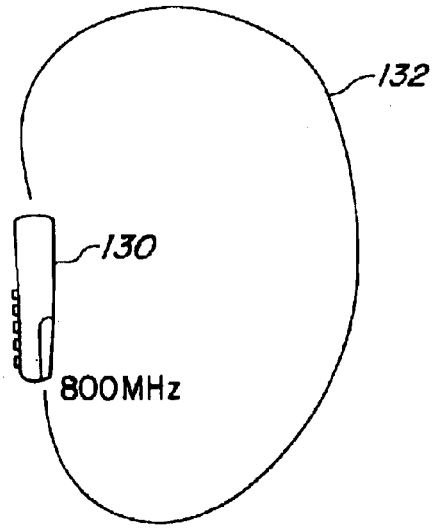
FIG. 11 is a diagrammatic illustration of the antenna lobe pattern for an internally carried antenna in a wireless handset for use in the 800 MHz band.

There is, however, an unusual result when utilizing the shielded meander line structure. As illustrated in FIG. 11 a standard handset 130 with an internal antenna has an antenna lobe 132 which looks like half a dipole. This is true for 800 MHz operation. However, and referring now to FIG. 12, for 1.9 gigahertz operation at PCS frequencies, the main lobe 132 is narrowed and points downwardly which is referred to as "down firing". This is due to the ground plane effect of the circuits within the cell phone and is directly related to the ground plane or planes utilized in the printed circuit board or boards within the cell phone.

Figure 13:
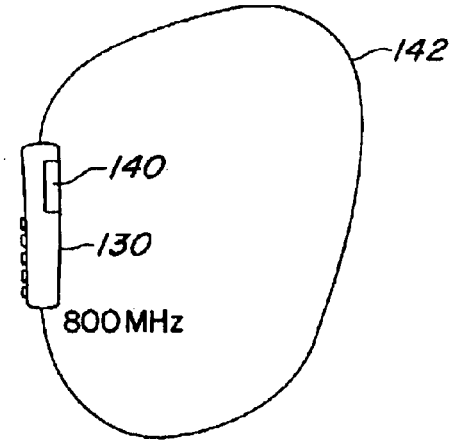
FIG. 13 is a diagrammatic illustration of the lobe structure for a meander line loaded antenna embedded into a wireless handset operating in the 800 MHz band; and, FIG. 14 is a diagrammatic illustration the antenna lobe pattern for an embedded meander line loaded antenna at 1.9 GHz having a top shield which eliminates any down firing ground plane effect.

Referring to FIG. 13, if handset 130 were to be provided with a wide band meander line antenna 140, then at 800 MHz the major antenna lobe would be a dipole type lobe 142.

Figure 12:
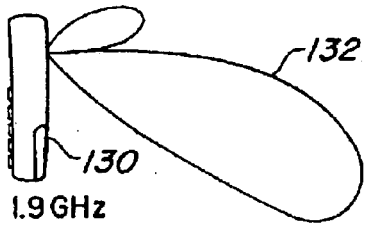
FIG. 12 is a diagrammatic illustration of the antenna pattern of an internally carried wireless handset antenna in the 1.9 GHz band showing a down firing pattern due to the ground plane effect caused by the ground plane of the printed circuit board or boards used in the wireless handset.
Figure 14:
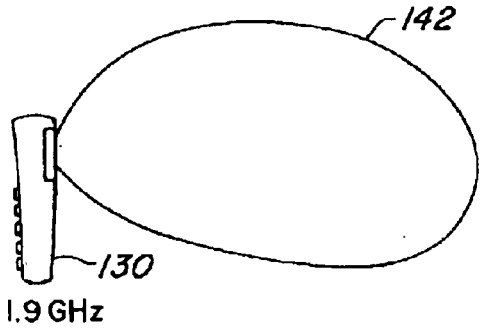

Referring to FIG. 14, were this handset operated in the 1.9 GHz region, the main lobe 142 while somewhat narrow would still be in the horizontal direction, thus eliminating the ground plane effect associated with the FIG. 12 embodiment.

What can be seen is that a compact wideband wireless handset and antenna can be achieved with a low cutoff frequency including all the bands of interest through the utilization of the top shield. Moreover, the utilization of the top shield in combination with the meander line loaded antenna provides the desirable horizontal lobe and eliminates down firing.

Having now described a few embodiments of the invention, and some modifications and variations thereto, it should be apparent to those skilled in the art that the foregoing is merely illustrative and not limiting, having been presented by the way of example only. Numerous modifications and other embodiments are within the scope of one of ordinary skill in the art and are contemplated as falling within the scope of the invention as limited only by the appended claims and equivalents thereto.

What is claimed is:

1. A slow wave meander line having a conductor plate, sections of alternating impedances relative to said conductor plate and a top shield connected to said conductor plate, said top shield lowering the resonant frequency thereof, whereby said meander line when used as a narrow band antenna lowers the resonant frequency of said narrow band antenna and when used as a wide band antenna lowers the low frequency cut off of said wide band antenna, and further including an antenna coupled thereto, said meander line functioning as an antenna coupler.

2. The meander line of claim 1, wherein said antenna has a distal end and the antenna coupled thereto is grounded at the said distal end.

3. A method for eliminating skip-induced dead zones in the transmission of a signal from one location on the surface of the earth to another location on the surface of the earth, comprising the steps of:

providing a truncated antenna and a transmitter coupled thereto at said one location; and, providing a slow wave meander line coupler to the antenna and the transmitter, the meander line coupler including a top shield connected to the conductor plate thereof, whereby the truncated antenna can operate at a frequency lower than that associated with the truncated antenna alone.

4. The method of claim 3, wherein the operating frequency is in the 4 megahertz range, thus to be able to establish skip communications between 30 to 100 miles.

5. A frequency switched slow wave meander line, comprising:

a top conductor;

a bottom conductor;

an upstanding conductor connected between said top and bottom conductors;

a bottom conductor plate electrically isolated from said bottom conductor;

a top shield overlying said top conductor and coupled to said conductor plate; and, a switch interposed in said upstanding conductor, said top shield reducing the voltage stress on said switch.

* * * * *